US005098265A

United States Patent [19]

Machida et al.

[11] Patent Number: 5,098,265

[45] Date of Patent: Mar. 24, 1992

[54] OIL-FREE SCROLL FLUID MACHINE WITH PROJECTING ORBITING BEARING BOSS

[75] Inventors: Shigeru Machida, Ibaraki; Masahiro Yoshioka, Takarazuka; Toshio Kushiro, Kawanishi, all of Japan

[73] Assignees: Hitachi, Ltd., Tokyo; Shin Meiwa Industry Co., Ltd., Hyogo, both of Japan

[21] Appl. No.: 507,528

[22] Filed: Apr. 11, 1990

[30] Foreign Application Priority Data

Apr. 20, 1989 [JP] Japan ..... 1-98828

[51] Int. Cl.[5] ..... F04C 18/04

[52] U.S. Cl. ..... 418/55.2; 418/55.3; 418/55.6

[58] Field of Search ..... 418/55.1, 55.2, 55.3, 418/55.4, 55.5, 55.6

[56] References Cited

U.S. PATENT DOCUMENTS

| | | | |
|---|---|---|---|
| 3,560,119 | 2/1971 | Busch et al. | 418/55.3 |
| 4,464,100 | 8/1984 | Machida et al. | 418/55.2 |
| 4,466,784 | 8/1984 | Hiraga | 418/55.1 |

FOREIGN PATENT DOCUMENTS

| | | | |
|---|---|---|---|
| 6361786 | 3/1968 | Japan . | |
| 57-28890 | 2/1982 | Japan | 418/55.4 |
| 57-131896 | 8/1982 | Japan . | |
| 57-195801 | 12/1982 | Japan | 418/55.1 |

*Primary Examiner*—John J. Vrablik

*Attorney, Agent, or Firm*—Antonelli, Terry, Stout & Kraus

[57] ABSTRACT

An oil-free scroll fluid machine having a stationary scroll member, an orbiting scroll member opposing the stationary scroll member, an orbiting bearing boss provided on the orbiting scroll member and receiving an orbiting bearing, and a drive shaft drivingly engaging with the orbiting scroll member through the orbiting bearing and causing an orbiting motion of the orbiting scroll member relative to the stationary scroll member. The orbiting bearing boss projects from the orbiting scroll member into a compression chamber formed between both scroll members beyond a plane which is at ½ the height of the wrap on the stationary scroll member. An ample discharge space is formed between the end of the orbiting bearing boss and the end plate of the stationary scroll member.

22 Claims, 3 Drawing Sheets

OIL-FREE SCROLL FLUID MACHINE WITH PROJECTING ORBITING BEARING BOSS

BACKGROUND OF THE INVENTION

The present invention broadly relates to a scroll fluid machine having scroll members which make an orbiting motion relative to each other with their spiral wraps meshing with each other so that volumes of working chambers defined by both wraps are progressively varied to compress, expand or transfer a gas, and more particularly, to an oil-free scroll fluid machine in which lubrication is not conducted in the working chambers although bearings and other portions are lubricated.

Japanese Patent Unexamined Publication Nos. 57-131896 and 63-61786 disclose scroll fluid machines in which the position of the center of gravity of the orbiting scroll member and the positional relationship between the center of gravity and the orbiting bearing are suitably determined so as to minimize fluttering and precession of the orbiting scroll member thereby improving the reliability of the orbiting bearing.

The scroll fluid machine disclosed in Japanese Patent Unexamined Publication No. 57-131896, however, is not designed with full consideration of the discharge passage along which a gas is discharged from the machine. Therefore, when this scroll machine is used to compress, expand or transfer a gas at a large flow rate, the discharged gas encounters a large resistance due to restricted volume of the discharge passage. On the other hand, the scroll fluid machine disclosed in Japanese Patent Unexamined Publication No. 63-61786 encounters difficulties in supplying a lubricating oil into the orbiting bearing. In addition, this type of scroll fluid machine is not designed to operate satisfactorily when the ratio of the discharge pressure to the suction pressure is small. It is also to be pointed out that this type of scroll fluid machine is not designed to enable easy maintenance work on the orbiting bearing. Furthermore, a considerably large moment acts on the orbiting scroll member by the gas during operation of the machine.

SUMMARY OF THE INVENTION

Accordingly, an object of the present invention is to provide an oil-free scroll fluid machine which is improved to stabilize the motion of the orbiting scroll member and to attain a higher reliability of the orbiting bearing, while reducing vibration and noise produced during operation of the fluid machine.

Another object of the present invention is to provide an oil-free scroll fluid machine which is improved to facilitate maintenance and to reduce flow resistance in the discharge passage.

To these ends, according to one aspect of the present invention, there is provided an oil-free scroll fluid machine in which an orbiting bearing through which an orbiting scroll member is drivingly engaged by a drive shaft is formed so as to project into a compression chamber which are defined by a wrap on the orbiting scroll member and a wrap on a stationary scroll member around the orbiting bearing, with the orbiting scroll member being prevented from rotating about its own axis by an anti-rotation mechanism such as an Oldham's joint or a plurality of crank pins.

According to another aspect of the invention, in order to attain the second object mentioned above, the end of the orbiting bearing projecting onto the compression chamber is covered by a detachable bearing cover, and a discharge opening is formed in the central region of the stationary scroll member which is on the extension of the orbiting bearing.

These and other objects, features and advantages of the present invention will become clear from the following description of the preferred embodiments when the same is read in conjunction with the accompanying drawings.

DESCRIPTION OF THE PREFERRED EMBODIMENTS

Preferred embodiments of the present invention will be described with reference to the accompanying drawings.

Figure 1:
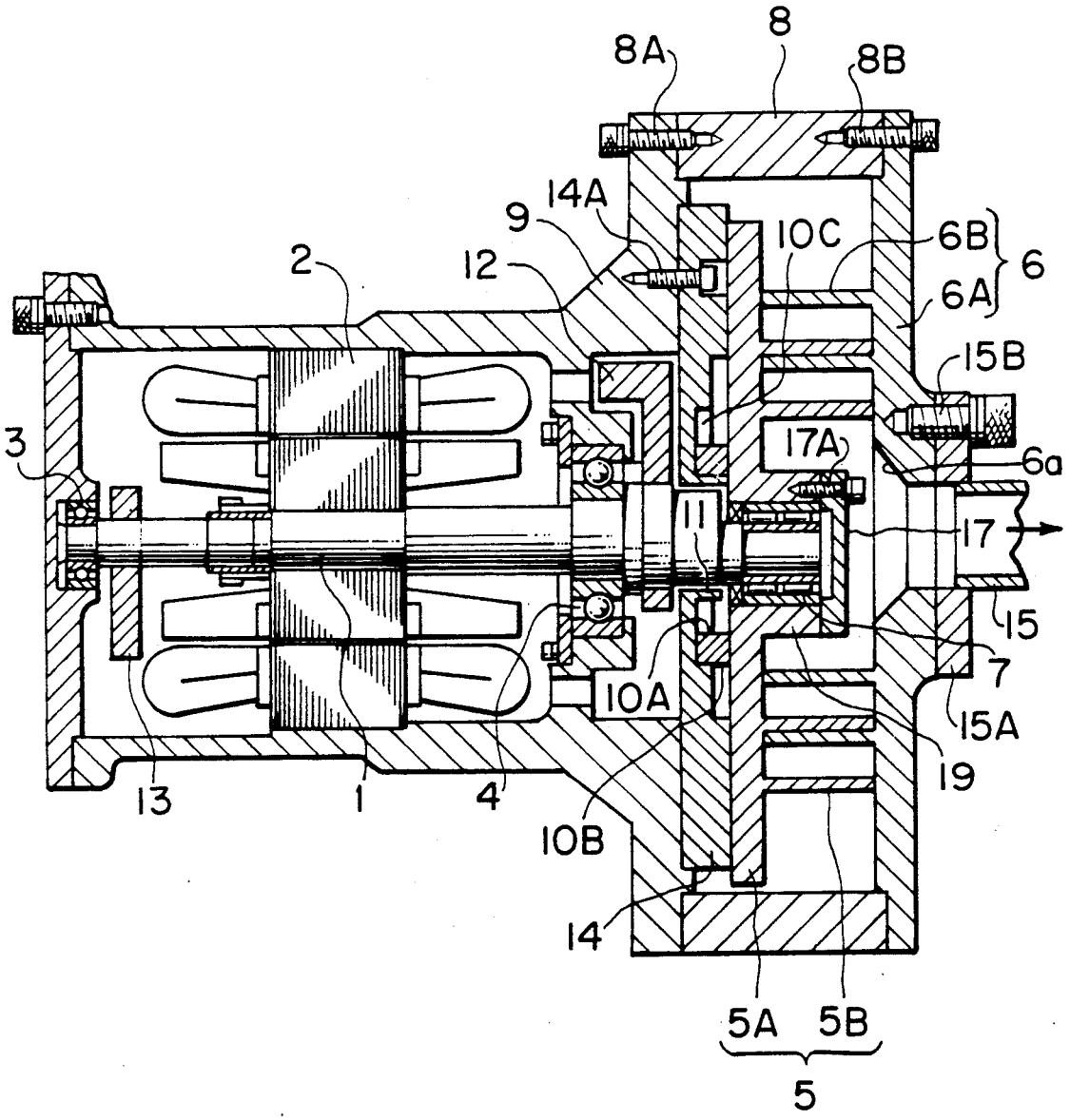
FIG. 1 is a longitudinal sectional view of an embodiment of the oil-free scroll fluid machine in accordance with the present invention.

Referring now to the drawings wherein like reference numerals are used throughout the various views to designate like parts and, more particularly, to FIG. 1, according to this figure, a scroll blower forming an oil-free scroll fluid machine includes an electric motor 2 housed in a motor case 9, and a crankshaft 1 which is integral with the rotor shaft of the motor 2 and which serves as a drive shaft of the blower. The crankshaft 1 is supported in the motor case 9 through a main bearing 4 and an auxiliary bearing 3. An orbiting scroll member 5 has an end plate 5A and a spiral wrap 5B formed along an involute or a similar curve so as to project from one side of the end plate 5A away from the crankshaft 1. The orbiting scroll member 5 is operatively connected to the adjacent end of the crankshaft 5 through an orbiting crankshaft 1. A stationary scroll member 6 has an end plate 6A and a spiral wrap 6B formed on one side of the end plate 6A along an involute or a similar curve so as to project towards the orbiting scroll member 5. The stationary scroll member 6, with its wrap 6B meshing with the wrap 5B of the orbiting scroll member 5, is fixed by bolts 8B to a housing 8 which is secured to the motor case 9 by, for example, bolts 8A. The meshing wraps 5B and 6B, in cooperation with both end plates 5A and 5B, define compression chambers therebetween. An annular thrust bearing 14 is fixed to the motor case 9 by bolts 14A so as to support the end plate 5A of the orbiting scroll member 5 at the back side of the end plate 5A opposite to the wrap 5B, thus limiting the axial displacement of the orbiting scroll member. A small gap is formed between both wraps 5B and 6B when both scroll members are assembled together.

The orbiting scroll member 5 is prevented from rotating about its own axis by an anti-rotation mechanism such as for example , an Oldham's joint 10 including an annular Oldham's ring 10B having keys 10A (only one of them is shown) arranged at a 90° phase difference, a groove 10C formed in the thrust bearing 14 so as to receive one of the keys 10A and a groove (not shown) formed in the end plate 5A and receiving the other key 10A. Thus, the Oldham's mechanism 10 prevents the orbiting scroll member 5 from rotating about its own axis, although it permits the same to revolve or orbit with respect to the stationary scroll member 6.

In order to attain a mass-balance of the rotational system, the crankshaft 1 is provided with a balance weight 12 and the counter weight 13. The end plate 5A of the orbiting scroll member 5 has an orbiting bearing boss 19 projecting into the compression chamber beyond ½ the height of the wrap 6B of the stationary scroll member 6B. A bearing cover 17 is detachably secured by, for example, bolts 17A to cover the open end of the orbiting bearing boss 19 facing the stationary scroll member 6. The portion of the stationary scroll member 6 around the orbiting bearing boss 19 is devoid of the scroll wrap 6B so as to provide a discharge space. The bearing cover 17 becomes accessible by removing the stationary scroll member 6 from the housing 8, so that supply of a lubricant to the orbiting bearing 7 is made possible by removing the bearing cover 17. A lubricant scattering prevention member 11 is provided on the inner side of the thrust bearing 14 where the Oldham's ring 10B is disposed, for the purpose of preventing scattering of the lubricant to maintain good lubrication of the orbiting bearing 7. A discharge pipe 15, fixed by welding to a flange 15A, is secured by bolts 15B to the central region of the stationary scroll member 6 which is on the extension of the orbiting bearing 7. This central region of the stationary scroll member 6 has an opening 6A diverging towards the orbiting scroll member 5. The diameter of the diverging end of this opening is greater than the outside diameter of the orbiting bearing boss 19. Only the bearings 3, 4 and 7 and the thrust bearing 14 are lubricated in this machine. Lubrication of these bearings can be satisfactorily provided by a grease or a solid lubricant, so that the compression chamber is substantially free of lubricant.

In operation, as the crankshaft 1 is rotated by the motor 2, a gas is introduced into a compression chamber formed between the orbiting scroll member 5 and the stationary scroll member 6 from a suction port (not shown). The compression chamber is progressively moved towards the center of the machine while decreasing its volume so that the gas is compressed and transferred to the outside of the machine through the discharge pipe 15. A force resulting from a compression of the gas, produces a radial force which directly acts on the orbiting bearing 7. The orbiting bearing 7 involves the center of gravity of the orbiting scroll member 5 so that the above-mentioned radial force does not produce any moment which would act on the orbiting scroll member 5. It is thus possible to enhance the stability of the orbiting scroll member 5. This arrangement also prevents local or uneven contact between the crankshaft 1 and the orbiting bearing 7, so that the orbiting bearing 7 can operate for a long time with high degree of reliability. In case of any inferior lubrication in the orbiting bearing 7, sufficient lubrication is recovered without difficulty and in a short time because the user can supply the lubricant to this bearing by removing the bearing cover 17.

In the oil-free scroll blower having the described construction, the force generated by the compressed gas is received merely as a radial load by the orbiting bearing 7 which projects into the compression chamber, so that no moment which would cause fluttering and precession of the orbiting scroll member 5 is produced. In addition, the orbiting scroll member 5 is stably supported by the thrust bearing at its side opposite to the wrap. The orbiting scroll member 5 therefore, can orbit in a stable manner. In this embodiment, the orbiting bearing 7 is composed of a plurality of roller bearings so that local concentration of force is avoided in the orbiting bearing 7. The above-described stabilizing effect enables the Oldham's mechanism 10 to bear only the force for preventing the rotation of the orbiting scroll member. In addition, the maintenance work is facilitated because the additional supply of the lubricant to the orbiting scroll member is made possible simply by removing the bearing cover 17 on the orbiting bearing boss 19. Consequence, the reliability of the driving system is remarkably improved. The discharge opening is located in the central region of the stationary scroll member and is substantially conically diverged towards the orbiting scroll member such that the diverging end of the discharge opening has a diameter greater than the outside diameter of the orbiting bearing boss. This arrangement considerably reduces the flow resistance of the discharge passage. In addition, the discharge opening is always opened during operation of the machine, without being closed by the orbiting bearing. Therefore, the compression of the gas can be conducted without substantial pulsation of pressure, thus enabling smooth discharge of the compressed gas.

Figure 2:
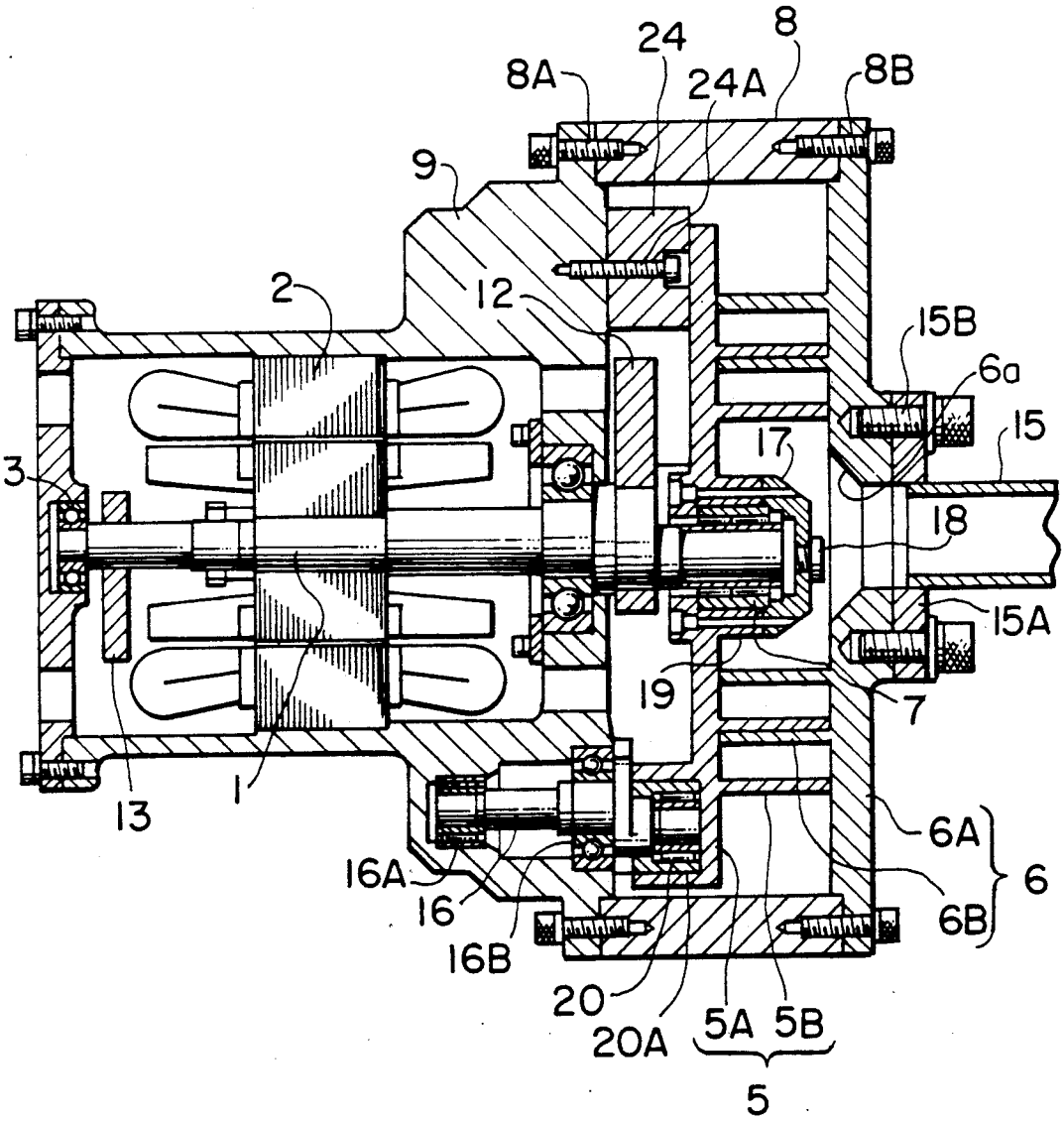
FIG. 2 is a longitudinal sectional view of another embodiment of the oil-free scroll fluid machine of the present invention.

The embodiment of FIG. 2 differs from the embodiment of FIG. 1 in that the anti-rotation mechanism for preventing the orbiting scroll member 5 from rotating about its own axis is composed of three crank pins 16 which are arranged on a common circle at a constant circumferential pitch. A journal portion of each crank pin 16 is supported on the motor case 9 through a pair of bearings 16A and 16B. The crank pin 16A has an eccentric pin portion adjacent to the orbiting scroll member 5. This eccentric pin portion of the crank pin engages with the orbiting scroll member 5 through a roller bearing 20 provided with an elastic member 20A such as of rubber. The orbiting bearing cover 17 is provided with a plug 18 which is accessible and, hence, detachable through the discharge opening after removal of the discharge pipe 15. Three arcuate thrust bearing segments 24 are fixed to the portions of the motor case 9 between adjacent crank type pins 16 so as to stably support the orbiting scroll member 5. The orbiting scroll member 5, which is stably backed up by the thrust bearing segments 24, can orbit very smoothly by virtue of the roller bearings 20 having elastic members 20A such as of rubber. The provision of the plug 18 is very effective from the view point of ease of maintenance. Namely, additional supply of the lubricant to the orbiting bearing 7 is possible without removing the stationary scroll member 6, simply by disconnecting the discharge pipe 15 and withdrawing the plug 18, whereby the time required for maintenance is remarkably shortened. The supply of the lubricant to the orbiting bearing 7 on the orbiting scroll member 5 can be conducted any time when desired, thereby extending the life of the orbiting bearing 7 the lubrication of which has been a critical problem.

Scroll blowers capable of discharging air at a large flow rate and with a small pressure ratio have been described as preferred embodiments. In each of these scroll blowers, the orbiting bearing is projected into the compression chamber so as to occupy a large space. This, however, does not cause any increase in the flow resistance to the discharged gas because the discharge passage has a correspondingly large cross-sectional area.

Figure 3:
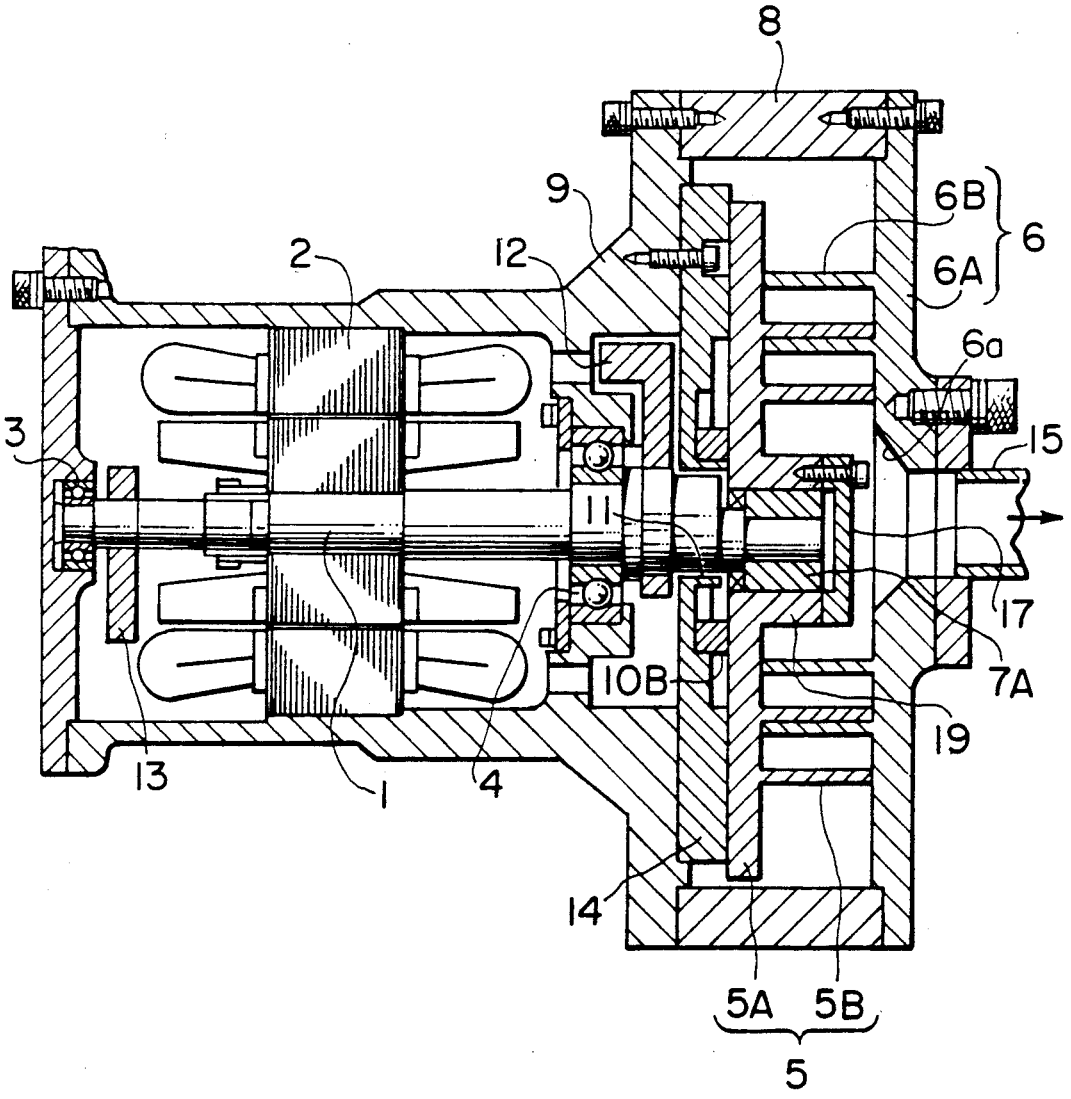
FIG. 3 is a longitudinal sectional view of still another embodiment of the oil-free scroll fluid machine in accordance with the present invention.

The embodiment of FIG. 3 features the use of slide-type bearings 7A in the orbiting bearing 7 in place of the rolling-type bearings used in the embodiments shown in FIGS. 1 and 2.

As has been described, the present invention offers various advantages. Firstly, the reliability of the orbiting bearing is improved by elimination of any moment load which would act in this bearing, by virtue of the fact that the center of gravity and the point of action of force generated by the compressed gas are within the region of the orbiting scroll member. Secondly, stable orbiting motion of the orbiting scroll member is ensured by the specific construction and arrangement of the orbiting bearing and the thrust bearing. Thirdly, maintenance work such as additional supply of a lubricant to the orbiting bearing is remarkable facilitated. Furthermore, vibration and noise, as well a fluttering and precession of the orbiting scroll member, are significantly reduced, thus offering an oil-free scroll fluid machine which can operate quietly and without substantial vibration. Thus, the invention offers a scroll fluid machine which can operate with high degree of reliability despite that no lubrication is conducted for the parts in the compression chamber.

What is claimed is:

1. An oil-free scroll fluid machine comprising:

a stationary scroll member having an end plate and a spiral wrap formed to project from one side of said end plate along an involute or a similar curve;

an orbiting scroll member having an end plate and a spiral wrap formed to project from one side of said end plate along an involute or a similar curve, said wraps of said stationary and orbiting scroll members meshing with each other to form at least one non-lubricated working chamber, said orbiting scroll member being provided at a central portion thereof with an orbiting bearing boss for receiving an orbiting bearing;

a drive shaft drivingly connected to said orbiting scroll member through said orbiting bearing;

an anti-rotation means for preventing said orbiting scroll member from rotating about its own axis while allowing said orbiting scroll member to orbit, wherein a rotation of said drive shaft causes said orbiting scroll member to orbit relative to said stationary scroll member so that said working chamber is progressively moved towards a center of the machine while decreasing its volume, so that a gas is compressed and discharged without being contaminated by lubricant, wherein said orbiting bearing boss receives said orbiting bearing projecting from said orbiting scroll member into said working chamber beyond a plane located at a position ½ a height of said wrap of said stationary scroll member, and wherein said orbiting bearing includes a pair of cylindrical roller bearings arranged in said orbiting bearing boss at an axial spacing from each other.

2. An oil-free scroll fluid machine according to claim 1, further comprising a detachable cover means for entirely covering a working chamber side of said orbiting bearing boss for preventing a lubricant mist from entering into the working chamber.

3. An oil-free scroll fluid machine according to claim 1, wherein said anti-rotation means includes an Oldham's joint.

4. An oil-free scroll fluid machine according to claim 1, wherein said stationary scroll member is provided with a discharge opening disposed on an extension of a center axis of said orbiting bearing, said discharge opening diverging towards said orbiting scroll member to have a diameter greater than an outside diameter of said orbiting bearing boss.

5. An oil-free scroll fluid machine according to claim 1, further comprising a detachable plug provided on an end of said orbiting bearing boss adjacent to said stationary scroll member.

6. An oil-free scroll fluid machine according to claim 1, wherein said anti-rotation means includes a plurality of pin type cranks.

7. An oil-free scroll fluid machine according to claim 6, wherein each of said pin type cranks are supported at a case accommodating a drive means of the machine by a pair of bearings, and wherein a pin portion of each of said pin type cranks engages said orbiting scroll member through a roller bearing means provided with an elastic member.

8. An oil-free scroll fluid machine according to claim 7, wherein said plurality of pin type cranks are equidistantly spaced from each other and are disposed in a circular array.

9. An oil-free scroll fluid machine comprising:

a stationary scroll member having an end plate and a spiral wrap formed to project from one side of said end plate along an involute or similar curve;

an orbiting scroll member having an end plate and a spiral wrap formed to project from one side of said end plate along an involute or similar curve, said wraps of said stationary and orbiting scroll members meshing with each other to form at least one non-lubricating working chamber, said orbiting scroll member being provided at its central portion with an orbiting bearing boss for receiving an orbiting bearing;

a drive shaft drivingly connected to said orbiting scroll member through said orbiting bearing;

an anti-rotation means for preventing said orbiting scroll member from rotating about is own axis while allowing said orbiting scroll member to orbit, a rotation of said drive shaft causing said orbiting scroll member to orbit relative to said stationary scroll member so that said working chamber is progressively moved toward a center of the machine while decreasing its volume, so that a gas is compressed and discharged without being contaminated by lubricant, wherein said orbiting bearing boss receives said orbiting bearing projecting from said orbiting scroll member into said working chamber, a discharge space is formed between the end of said orbiting bearing boss and said end plate of said stationary scroll member, and wherein said orbiting bearing includes a pair of cylindrical roller bearings arranged in said orbiting bearing boss at an axial spacing from each other.

10. An oil-free scroll fluid machine according to claim 9, further comprising a detachable cover means for covering an end of said orbiting bearing boss adjacent to said stationary scroll member.

11. An oil-free scroll fluid machine according to claim 9, wherein said anti-rotation means includes an Oldham's joint.

12. An oil-free scroll fluid machine according to claim 9, wherein said stationary scroll member is provided with a discharge opening disposed on an extension of a center axis of said orbiting bearing, said discharge opening diverging towards said orbiting scroll member to have a diameter greater than an outside diameter of said orbiting bearing boss.

13. An oil-free scroll fluid machine according to claim 9, further comprising a detachable plug provided on an end of said orbiting bearing boss adjacent to said stationary scroll member.

14. An oil-free scroll fluid machine according to claim 9, wherein said anti-rotation means includes a plurality of pin type cranks.

15. An oil-free scroll fluid machine according to claim 14, wherein each of said pin type cranks are supported at a case accommodating a dive means of the machine by a pair of bearings, and wherein a pin portion of each of said pin type cranks engages said orbiting scroll member through a roller bearing means provided with an elastic member.

16. An oil-free scroll fluid machine according to claim 15, wherein said plurality of pin type cranks are equidistantly spaced from each other and are disposed in a circular array.

17. An oil-free scroll fluid machine comprising:

a stationary scroll member having an end plate and a spiral wrap formed to project from one side of said end plate along an involute or a similar curve;

an orbiting scroll member having an end plate and a spiral wrap formed to project from one side of said end plate along an involute or a similar curve, sad wraps of said stationary and orbiting scroll members meshing with each other to form at least one non-lubricating working chamber, said orbiting scroll member being provided at its central portion with an orbiting bearing boss for receiving an orbiting bearing;

a drive shaft drivingly connected to said orbiting scroll member through said orbiting bearing;

an anti-rotation means for preventing said orbiting scroll member rom rotating about its own axis while allowing said orbiting scroll member to orbit, a rotation of said drive shaft causing said orbiting scroll member to orbit relative to said stationary scroll member so that said working chamber is progressively moved towards a center of the machine while decreasing its volume, so that a gas is compressed and discharged without being contaminated by lubricant, wherein said orbiting bearing boss receives said orbiting bearing projecting from said orbiting scroll member into said working chamber beyond a plate located at a position ½ a height of said wrap of said stationary scroll member, a discharge space is defined between an end of said orbiting bearing boss and said end plate of said stationary scroll member, and wherein said orbiting bearing includes a pair of cylindrical roller bearings arranged in said orbiting bearing boss at an axial spacing from each other.

18. An oil-free scroll fluid machine according to claim 17, further comprising a detachable cover means for entirely covering a working chamber side of said orbiting bearing boss for preventing a lubricant mist from entering into the working chamber.

19. An oil-free scroll fluid machine according to claim 17, wherein said anti-rotation means includes an Oldham's joint.

20. An oil-free scroll fluid machine according to claim 17, wherein said anti-rotation means includes a plurality of pin type cranks.

21. An oil-free scroll fluid machine according to claim 17, wherein said stationary scroll member is provided with a discharge opening disposed on an extensions of a center axis of said orbiting bearing, said discharge opening diverging towards said orbiting scroll member to have a diameter greater than an outside diameter of said orbiting bearing boss.

22. An oil-free scroll fluid machine according to claim 17, wherein further comprising a detachable plug provided on an end of said orbiting bearing boss adjacent to said stationary scroll member.

* * * * *